United States Patent [19]

Kreiseder

[11] Patent Number: 4,709,830

[45] Date of Patent: Dec. 1, 1987

[54] CLOSURE WITH TOP CUT TAMPER EVIDENT FEATURE FOR WIDE MOUTH CONTAINER

[75] Inventor: Walter J. Kreiseder, Barrington, Ill.

[73] Assignee: Courtesy Mold & Tool Corporation, Wheeling, Ill.

[21] Appl. No.: 39,151

[22] Filed: Apr. 16, 1987

[51] Int. Cl.[4] ..... B65D 51/22

[52] U.S. Cl. ..... 220/258; 220/267; 220/277; 222/83

[58] Field of Search ..... 220/253, 267, 258, 266; 215/252, 257, 253; 222/83, 81, 480, 516, 548

[56] References Cited

U.S. PATENT DOCUMENTS

| | | | |
|---|---|---|---|
| 378,349 | 2/1888 | Williamson | 220/258 |
| 2,054,033 | 9/1936 | Conner et al. | 215/252 |
| 2,560,793 | 7/1951 | Greene | 215/252 |
| 3,261,504 | 7/1966 | Sabaka | 222/83 |
| 3,355,069 | 11/1967 | Miles | 222/83 |
| 3,402,855 | 9/1968 | Schroeder | 222/83 |
| 3,463,347 | 8/1969 | Kerr | 220/277 |
| 3,726,432 | 4/1973 | Gentile . | |
| 3,877,604 | 4/1975 | Brown | 220/267 |
| 3,994,413 | 11/1976 | Smyth | 222/83 |
| 4,125,203 | 11/1978 | Sovari et al. | 220/258 |
| 4,541,541 | 9/1985 | Hickman et al. | 220/258 |
| 4,548,331 | 10/1985 | Montgomery | 220/253 |
| 4,567,995 | 2/1986 | Kreiseder et al. | 220/253 |
| 4,598,837 | 7/1986 | Kreiseder et al. | 220/253 |
| 4,634,013 | 1/1987 | Bar-Kokhla | 222/83 |

*Primary Examiner*—George T. Hall

*Attorney, Agent, or Firm*—Silverman, Cass, Singer & Winburn, Ltd.

[57] ABSTRACT

A tamper evident closure for a wide mouth container having a closed endcap with an overcap to coaxially rotate thereabout. The overcap is provided with an integrally formed vertically depending knife blade which is constructed and arranged to engage a weakened portion of a raised annular rib in the endcap. The endcap is further provided with a raised hollow lug which projects vertically through a corresponding aperture in the overcap. The aperture is provided with a cutting edge. As the overcap is rotated, the cutting edge of the aperture severs the raised lug, thus providing an early indication of tampering. As the overcap is rotated further and completes a rotation about said container, the knife blade completely severs the weakened portion of the raised annular rib, thus completely detaching the closure from the container. An annular bead in said overcap and a corresponding groove in said endcap may be used to reattach the severed overcap to the body of the container for reuse of the contents therein.

14 Claims, 6 Drawing Figures

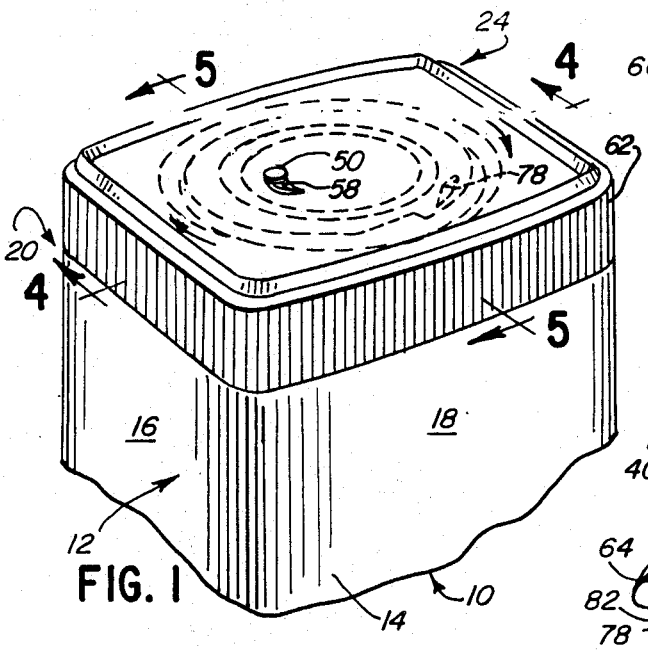
FIG. 1
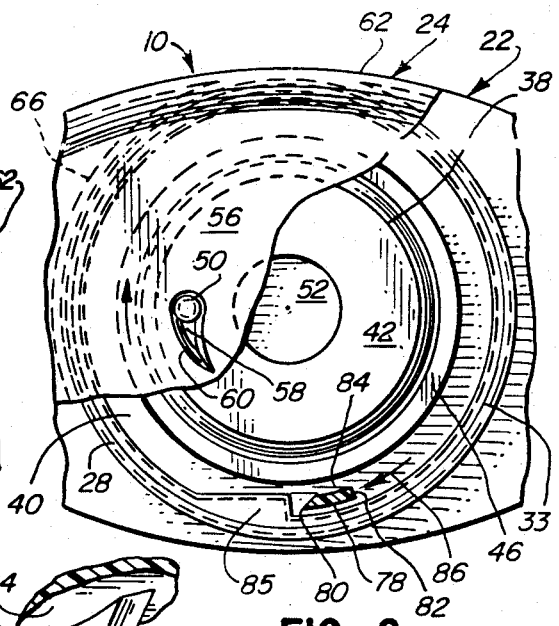
FIG. 2
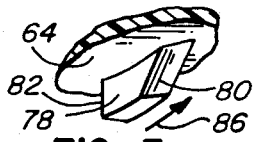
FIG. 3
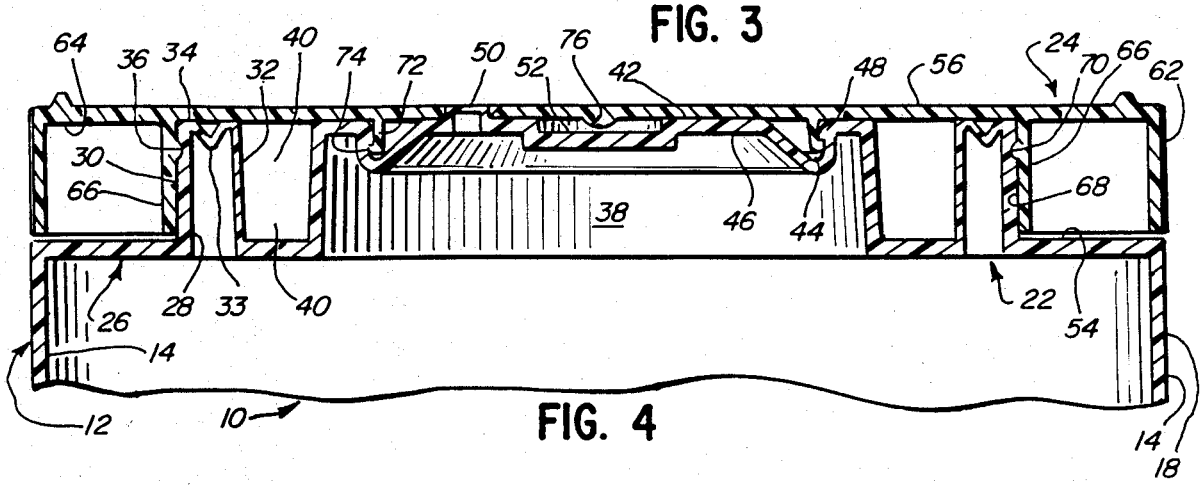
FIG. 4
FIG. 5
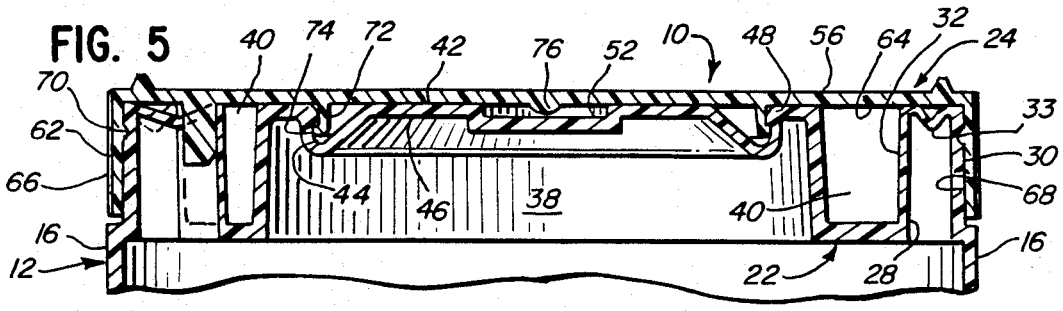
FIG. 6
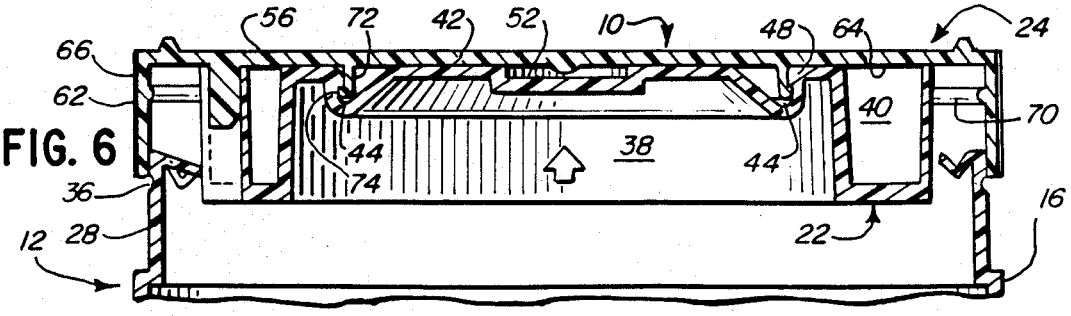

CLOSURE WITH TOP CUT TAMPER EVIDENT FEATURE FOR WIDE MOUTH CONTAINER

BACKGROUND OF THE INVENTION

1. Field of the Invention

This invention relates generally to tamper evident end closures for containers, and more particularly, to an end closure for a container for retaining a comestible product.

2. Description of the Prior Art

Containers of the type with which the present invention is concerned include end closures which maintain the container in a sealed condition after packaging and provide a non-resealable top or other means to indicate tampering with the container if the end closure is moved.

One type of previously available tamper evident container closure includes a rotatable cap portion formed with a knife or other means to engage a weakened annular panel portion in the end of the container. As the cap portion is rotated, the knife or other projections engage the weakened portion of the container end, causing the weakened panel to open. The weakened panel may be detached from the end of the container or may be partially inserted therein. A disadvantage of this type of container is that the aperture opened in this fashion is relatively small compared to the entire diameter of the container. As such, these types of closures are undesirable for use with wide mouth containers. These types of containers are disclosed in U.S. Pat. Nos. 3,877,604 and 3,726,432.

Another type of conventional means for indicating tampering involves the use of specially designed caps for bottles or containers having an external thread. As the overcap is rotated about the end of the container, a portion of the overcap brakes free, indicating tampering with the container. Although these devices provide a good indication of tampering, they are most useful with containers such as glass jars or bottles, wherein the seal of the end of the container is supplied by an external element which is not integrally formed with the container. This second type of closure is disclosed in U.S. Pat. Nos. 2,054,033 and 2,560,793.

It is also known to provide a sealed container with a member located at the sealed end thereof which is provided with a cutting edge. The member severs the tips of a plurality of projections in the container end in order to create a plurality of dispensing openings. This type of container opening device which is disclosed in U.S. Pat. No. 3,355,069, is not compatible with the opening of a wide mouth container.

U.S. Pat. No. 4,567,995 in the name of the same inventor as the inventor herein discloses an end closure for a container having a closed end with a cover rotatable thereabout. The closed end has a raised portion which is engaged by a knife blade integral with the cover. As the cover is rotated, the blade severs the raised portion, revealing an aperture providing access into the container. In this device, the closed end is not completely opened.

U.S. Pat. No. 4,598,837, also issued to the same inventor as the inventor herein, discloses a tamper evident element in a container wherein the rotation of an outer rotatable element causes an integral knife blade to sever and detach said element from the container, thus evidencing tampering when the cover is moved. This type of container is suitable for retaining food products in which small amounts are used at a time, but as is the case with the prior art referred to above, is not suitable for retaining food products such as frozen juices which, when the container is opened, are intended to be totally discharged from the container promptly or after a short storage period only.

Thus, it is desired to provide a tamper evident closure for wide mouth containers which can be used for packaging comestibles intended to be discharged in bulk from the container. It also is desired to provide a tamper evident container in which the rotating overcap knife blade which opens the container by rotation of the overcap is provided with structure to automatically engage a weakened raised rib of the container and maintain alignment of the blade with the rib.

The closure of the present invention includes an overcap rotatably secured to the closed end of a container and is provided with an integral knife blade. Twisting the overcap relative to the container causes the knife to engage and sever the raised rib of the container to totally remove a significant portion of the end of the container. The invention is also provided with a raised hollow lug in the end portion of the container which, while the container is sealed, projects through a corresponding aperture in the overcap. The overcap aperture is provided with a knife edge which, when the overcap is rotated, severs the raised lug, evidencing tampering.

SUMMARY OF THE INVENTION

The invention provides a closure for a wide mouth container wherein the closure is comprised of a closed endcap portion and an outer overcap portion which fits over the closed end of the container and is rotatably attached thereto. The overcap includes a depending knife blade formed integrally with the underside of the overcap and is arranged to engage a weakened annular rib projecting upwardly from the endcap. The closure also is provided with an upwardly projecting hollow lug projecting through a corresponding aperture in the overcap. The overcap aperture is provided with a cutting edge which, when the overcap is rotated, severs the raised lug to indicate tampering. As the overcap is rotated further, the depending knife blade engages the weakened portion of the annular rib and severs it. Once the rotation of the overcap is complete, the knife blade will have severed the entire rib, thus completely detaching the closure from the container.

The closure of the invention may also be provided with an alignment apparatus which preserves the alignment of the blade with the raised rib and at the same time, enables the overcap to be replaced upon the container once the container has been opened.

BRIEF DESCRIPTION OF THE DRAWING

FIG. 1 is a perspective view of a container incorporating the end closure of the invention;

FIG. 2 is a fragmentary top plan view of the closure shown in FIG. 1 with the overcap partially cut away to reveal the endcap;

FIG. 3 is an enlarged perspective view of the vertically depending knife blade shown in FIG. 2.

FIG. 4 is a sectional view taken along the line 4—4 of FIG. 1 in the direction indicated generally;

FIG. 5 is a sectional view taken along the line 5—5 of FIG. 1 in the direction indicated generally; and FIG. 6 is a sectional view similar to FIG. 5 with the overcap portion detached and moved vertically.

DESCRIPTION OF THE PREFERRED EMBODIMENT

Referring to FIG. 1, a container 10 is depicted having a body 12 including a wall 14. In the preferred embodiment, the body 12 is generally rectangular, having a pair of short sides 16, and a pair of long sides 18 wherein the length of long side 18 is longer than the length of short side 16; however, any configured container having a mouth and suitable for storing a product is contemplated by the present invention. The container 10 is further provided with a bottom (not shown) at one end, constructed and arranged to be secured to the body 12 once the container 10 has been filled with product. The bottom may be plastic or aluminum, and once installed, the contents of the container are hermetically sealed therein to preserve product life. Body 12 is provided at the end opposite the bottom with the end closure 20 of the invention.

Referring now to FIGS. 4 and 5, the end closure 20 is generally comprised of two main portions, these being a stationary endcap portion 22 and an overcap portion 24. The endcap 22 is integrally joined to the top 26 of container 10. The endcap is provided with an annular raised hollow rib 28 having an outside wall 30, an inside wall 32 and top 34. As seen in FIG. 2, the diameter of the rib 28 is approximately the same as the length of the short side 16 of the body 12. In the preferred embodiment, the outside wall 30 is provided with an annular groove 36, the purpose of which will be described hereinbelow. The top 34 of the rib 28 is provided with a weakened portion, which in the preferred embodiment, takes the form of a thin-walled generally v-shaped channel 33.

The endcap 22 is further provided with a raised central boss 38 of generally circular configuration which is positioned upon the endcap 22 to create an annular recess 40 between the boss 38 and the raised rib 28. The boss 38 is further provided with a face 42 into which is molded an annular recess 44 defining a recess boss 46 having an annular flange 48, and having a raised hollow lug 50. The lug 50 is formed integrally with the face 42 of the recess boss 46. The recess boss 46 may be further provided with a central recess 52 to assist in maintaining alignment of the overcap 24 with the endcap 22 in a manner explained below. Extending radially outwardly from the base of the outside wall 30 of the rib 28 is a radial lip 54 which integrally joins the top 26 of the container 10 with the wall 14.

FIGS. 1–5 also illustrate the overcap 24, provided with a generally horizontally-oriented flat lid 56 having a generally tear-drop shaped aperture 58 with an edge 60 designed for cutting. The aperture 58 is arranged to engage the raised hollow lug 50 of the endcap 22. The underside 64 of the lid 56 is further provided with a centrally located depending nub 76 which engages the boss recess 52 of endcap 22.

The overcap 24 is further provided with a vertically depending annular sidewall 62 co-dimensional with the short and long sides 16, 18 of the container body 12. The underside 64 of the overcap lid 56 is further provided with a vertically depending annular ring 66 spaced inwardly from the sidewall 62. Referring to FIGS. 2, 4 and 5, in order to accomodate for the rectangular shape of the container body 12, the annular ring 66 merges with the sidewall 62 along the width 16. This design feature enables the radius of the rib 28 to approximate the container width 16. The interior circumferential surface 68 of the ring 66 is provided with an annular bead 70 projecting toward the center of the overcap 24 and located to engage the annular groove 36 of the raised rib 28 as the overcap 24 is rotated about the endcap 22.

In order to rotatably secure the overcap 24 to the endcap 22, the underside 64 of the overcap 24 is provided with an annular depending projection 72 which is provided with a generally outwardly facing flange 74 spaced inwardly from the underside 64. The flange 74 of the overcap 24 is of a configuration which is generally complementary with the recessed annular flange 48 of the endcap 22. The internal diameter of the flange 48 is greater than the external diameter of the flange 74. Since the overcap 24 and the endcap 22 preferably are manufactured of a strong resilient plastic, such as polypropylene, there will be a snap fit inter-engagement between the complementary engaging faces of the flanges 48 and 74, to allow the overcap 24 to rotate about the endcap 22. Sidewall 62 may be ribbed or knurled to assist a user in gripping the container 10 to rotate the overcap 24 about the endcap 22.

Referring now to FIGS. 2, 3 and 5, the underside 64 of the lid 56 is further provided with a vertically depending knife blade 78 having a leading cutting edge 80 and a base end 82. The knife blade 78 is arranged upon the underside 64 so that when the endcap 24 is positioned upon the container 10 in the sealed condition as shown in FIG. 1, the knife blade will be in the position 84 shown in FIG. 2.

Once overcap 24 is rotated in the direction indicated by arrow 86, the knife blade 78 is rotated to engage the weakened top groove 33 of the raised rib 28 by entering an enlarged landing poriton 85 in the rib 28. As soon as the rotation of the overcap 24 is begun, the cutting edge 60 of the aperture 58 begins to engage the raised hollow lug 50. With further rotation, the edge 60 slices through and severs the raised hollow lug 50, providing an early indication that tampering of the container has occured.

As the overcap 24 is rotated still further, the depending knife blade 78 proceeds to sever the weakened groove 33 of the entire circumference of the annular rib 28. Upon 360° rotation of the overcap 24, the closure 20, comprising the overcap 24 and the severed portion of the endcap 22, will be totally detached from the container body 12. During the rotation, the alignment of the blade 78 within the rib 28 as it severs the grooved portion 33 is guided by the bead 70 which engages the annular groove 36 on the outside wall of the rib 30.

The overcap 24 may be fabricated from a homopolymer material and the endcap 22 from a relatively softer copolymer material, so that the blade 78 and the edge 60 may more readily cut the relevant portions of the endcap 22. Furthermore, the severing action of the blade 78 upon the raised rib 28 creates a large enough opening in the container 10 to permit the contents therein to be rapidly discharged by upending the opened container, or permits insertion of a utensil, such as a spoon, into the container to dispense some of the product retained therein.

Referring now to FIG. 6, the closure of the invention is shown with the closure 20 vertically elevated subsequent to the severing of the weakened portion 33 of the rib 28. It is evident that the entire endcap portion interior of the rib 28, including the rib inner wall 32, is attached to the overcap 24. Should the user of the container desire to replace the overcap upon the body 12 thereof, the annular bead 70 will engage the annular groove 36 to form a snap lock fastener. Aside from the fact that the overcap 24 is vertically elevated, and the weakened portion 33 of the rib 28 has been severed, the features of FIG. 6 are identical to those depicted in FIG. 5.

Thus, the invention provides an improved, tamper evident end closure for a wide mouth container. The parts are molded from plastic and are easily assembled for use. Preferably, the overcap 24 and the blade 78 are molded from a more rigid plastic material than the endcap 22 to facilitate severing of the weakened portions 33 and 50. The endcap portion 24 is closed and thus provides for hermetic sealing of the container after packaging. By rotating the overcap 24, the blade 78 severs the top 34 of the upstanding annular rib 28, allowing the overcap 24 and the endcap 22 to be detached from the container body 12. Simultaneously with the rotation of the overcap, the knife edge 60 of the teardrop aperture 58 severs the raised hollow lug 50, providing an early indication of tampering.

While a preferred embodiment of the invention has been shown, it will be understood that the invention may be otherwise embodied within the scope of the appended claims. Minor variations in the structure and in the arrangement and size of the various parts may occur to those skilled in the art without depending from the spirit and scope of the invention.

I claim:

1. A closure for a container having a body with a top end, the closure comprising:

a stationary endcap integrally joined to and integrally closing said top end, said endcap and top end being joined by a raised annular rib, said rib having a weakened portion;

an overcap attached to and covering said endcap and being coaxially rotatable thereabout; and a knife blade secured to and depending from said overcap and arranged to engage and circumscribe said weakened portion as said overcap is rotated about said endcap to sever said endcap from said container.

2. The closure defined in claim 1 wherein said endcap includes a raised hollow lug which protrudes through a corresponding aperture formed in said overcap.

3. The closure defined in claim 2 wherein said aperture includes a knife edge which engages and severs said lug upon rotation of said overcap.

4. The closure defined in claim 1 wherein said overcap is provided with means for maintaining engagement of said knife blade with said weakened portion.

5. The closure defined in claim 4 wherein said means for maintaining engagement include an annular ring depending from said overcap and including an annular bead which engages an annular groove formed in said raised rib of said endcap.

6. The closure defined in claim 1 wherein said weakened portion is formed proximate a top portion of said rib.

7. The closure defined in claim 1 wherein said said rib has a grooved top portion.

8. The closure defined in claim 1 wherein said container body has a length and a width shorter than said length, and the diameter of said raised rib approximates said width.

9. A closure for a container having a body with a top end, the closure comprising:

a stationary endcap integrally joined to and sealingly closing said top end, said endcap and top end being joined by a raised annular rib, said rib having a weakened top portion, a raised hollow lug formed in said endcap;

an overcap attached to and covering said endcap and being coaxially rotatable thereabout, said overcap having a lid with an aperture found therein corresponding in location to said raised lug, the aperture including a knife edge surface;

a knife blade secured to and depending from said overcap and arranged to engage and circumscribe said weakened portion as said overcap is rotated about said endcap portion severing said endcap to sever said container; and said rotation of said overcap about said endcap causing said knife edge surface to sever said lug.

10. The closure defined in claim 9 wherein said overcap is provided with means for maintaining engagement of said knife blade with said weakened portion.

11. The closure defined in claim 10 wherein said means for maintaining engagement include an annular ring depending from said overcap and including an annular bead which engages an annular groove formed in said raised rib of said endcap.

12. The closure defined in claim 9 wherein said rib has a grooved top portion.

13. The closure defined in claim 9 wherein said container body has a length and a width shorter than said length, and the diameter of said rib approximates said width.

14. A closure for a container having a body with a top end, a pair of long sides, and a pair of short sides, each shorter than said long sides, the closure comprising:

a stationary endcap integrally joined to and forming a closed top end of said container, said endcap and top end being joined by a raised annular rib, said rib having a grooved top portion, a raised hollow lug formed in said endcap;

an overcap attached to and covering said endcap and being coaxially rotatable thereabout, said overcap having a lid, an annular sidewall depending from said lid and having an annular bead engaging said groove in said rib and an aperture formed in said lid corresponding in location to and receiving said raised lug, the aperture including a knife edge surface;

a knife blade secured to and depending from said overcap and arranged to engage and circumscribe said weakened portion as said overcap is rotated about said endcap to sever said endcap from said container; and said rotation of said overcap about said endcap simultaneously causing said knife edge surface to sever said lug.

* * * * *